US011448013B2

(12) United States Patent
Miller

(10) Patent No.: US 11,448,013 B2
(45) Date of Patent: Sep. 20, 2022

(54) METHOD AND APPARATUS FOR PERCUSSION DRILLING

(71) Applicant: Epiroc Drilling Solutions, LLC, Garland, TX (US)

(72) Inventor: Peter D. Miller, Rockwall, TX (US)

(73) Assignee: Epiroc Drilling Solutions, LLC, Garland, TX (US)

( * ) Notice: Subject to any disclaimer, the term of this patent is extended or adjusted under 35 U.S.C. 154(b) by 868 days.

(21) Appl. No.: 16/210,225

(22) Filed: Dec. 5, 2018

(65) Prior Publication Data

US 2020/0181981 A1 Jun. 11, 2020

(51) Int. Cl.

| | |
|---|---|
| ***E21B 44/00*** | (2006.01) |
| ***E21B 4/14*** | (2006.01) |
| ***E21B 4/04*** | (2006.01) |
| ***E21B 1/00*** | (2006.01) |

(52) U.S. Cl.

CPC ..... *E21B 4/14* (2013.01); *E21B 1/00* (2013.01); *E21B 4/04* (2013.01); *E21B 44/00* (2013.01)

(58) Field of Classification Search

None

See application file for complete search history.

(56) References Cited

U.S. PATENT DOCUMENTS 4,165,789 A 8/1979 Rogers
4,195,699 A * 4/1980 Rogers ..... E21B 44/00 173/9
4,699,223 A 10/1987 Noren
5,458,207 A * 10/1995 Mattero ..... E21B 44/00 73/152.43
5,720,355 A * 2/1998 Lamine ..... E21B 47/024 175/45
5,735,358 A 4/1998 Lyon (Continued)

FOREIGN PATENT DOCUMENTS

EP 0112810 A2 4/1984
EP 3221554 A1 9/2017

OTHER PUBLICATIONS

Samuel G.R., "Percussion Drilling . . . Is It a Lost Technique? A Review," Permian Basin Oil and Gas Recovery Conference, Mar. 27-29, 1996, SPE-35240-MS.

(Continued)

*Primary Examiner* — Lina M Cordero

(74) *Attorney, Agent, or Firm* — Harper & Bates LLP; Shannon W. Bates

(57) ABSTRACT

A method for maintaining a penetration rate of a drilling operation, where the drilling operation is carried out by a drilling rig having a hammer drill apparatus. A reference penetration rate for the hammer drill bit is chosen. A starting depth of cut is computed from the reference penetration rate, the measured hammer frequency, and the drill bit parameters. The system measures the actual penetration rate of the drill bit and computes an actual depth of cut. From the actual depth of cut a target bit rotation speed is computed. The target rotation speed is compared to the actual rotation speed, and the rotation speed is adjusted up or down to set the bit rotation speed at a value that will maintain the target rotation speed, notwithstanding changes in hammer frequency or ground conditions.

21 Claims, 8 Drawing Sheets

(56) References Cited

U.S. PATENT DOCUMENTS

| | | | | |
|---|---|---|---|---|
| 6,192,998 | B1 * | 2/2001 | Pinckard | E21B 44/00 175/57 |
| 6,424,919 | B1 | 7/2002 | Moran et al. | |
| 6,502,650 | B1 * | 1/2003 | Beccu | E21B 10/36 175/417 |
| 6,957,707 | B2 | 10/2005 | Koivunen et al. | |
| 7,198,117 | B2 | 4/2007 | Uitto | |
| 7,159,674 | B2 | 7/2007 | Egerstrom | |
| 7,428,938 | B2 | 9/2008 | Marshall | |
| 7,604,070 | B2 | 10/2009 | Kemppainen | |
| 7,654,337 | B2 | 2/2010 | Noel | |
| 7,717,190 | B2 | 5/2010 | Keskiniva et al. | |
| 7,762,352 | B2 | 7/2010 | Pettersson | |
| 8,121,971 | B2 | 2/2012 | Edwards et al. | |
| 8,397,839 | B2 | 3/2013 | Lyon | |
| RE44,427 | E | 8/2013 | Runquist et al. | |
| 9,470,081 | B2 | 10/2016 | Henriksson | |
| 9,574,432 | B2 * | 2/2017 | Ringer | E21B 4/02 |
| 9,951,616 | B2 * | 4/2018 | Uotila | E21B 7/025 |
| 2009/0044976 | A1 * | 2/2009 | Pettersson | E21B 44/04 175/24 |
| 2016/0008406 | A1 | 3/2016 | Mchugh et al. | |
| 2016/0010859 | A1 | 4/2016 | Waxse | |
| 2018/0156022 | A1 * | 6/2018 | Miller | E21D 9/006 |

OTHER PUBLICATIONS

Cavanough, G.L., et al., "A Self-Optimizing Control System for Hard Rock Percussive Drilling," IEEE/ASME Transactions on Mechatronics (Apr. 2008) 13(2):153-157.

Izquierdo, L.E., et al., "A methodology for estimation of the specific rock energy index using corrected down-the-hole drill monitoring data," Mining Technology, Transactions of the Institutions of Mining and Metallurgy: Section A (2004) 113(4):225-236.

* cited by examiner

METHOD AND APPARATUS FOR PERCUSSION DRILLING

BACKGROUND

Technical Field

This disclosure relates to methods and apparatus for drilling boreholes in the earth in general, and more specifically, to methods and apparatus for percussion drilling of blast holes of the type commonly used in mining and quarrying operations.

Background

Various methods and apparatus for drilling boreholes are known in the art and have been used for decades in a wide variety of applications, for example, from oil and gas production, to mining, to quarrying operations. In mining and quarrying operations, such boreholes are typically filled with an explosive that, when detonated, ruptures or fragments the surrounding rock. Thereafter, the fragmented material can be removed and processed in a manner consistent with the particular operation. When used for this purpose, then, such boreholes are commonly referred to as "blast holes," although the terms may be used interchangeably.

A number of factors influence the effectiveness of the blast, including the nature of the geologic structure (i.e., rock), the size and spacing of the blast holes, the burden (i.e., distance to the free face of the geologic structure), the type, amount, and placement of the explosive, as well as the order in which the blast holes are detonated. Generally speaking, the size, spacing, and depth of the blast holes represent the primary means of controlling the degree of rupture or fragmentation of the geologic structure, and considerable effort goes into developing a blast hole specification that will produce the desired result.

The present disclosure generally relates to the technology of percussion drilling with a down-the-hole drill (called here, a "DHD"). Typical DHDs involve a combination of percussive and rotational movement of the drill bit to drill or chip away rock and are often referred to as "hammer drills". Such DHDs are typically powered by a rotatable drill string attached to a drilling platform, that supplies rotation and high-pressure air for percussive drilling. In percussive drilling, rock cutting is a result of percussive impact forces rather than shear forces. In other words, rotation of the DHD merely serves to rotationally index the drill bit to fresh rock areas after the drill bit impacts the rock surface, rather than to impart shear cutting forces to the rock surface. The present disclosure relates to down-the-hole drilling that comprises indexing of the drill-bit buttons in conjunction with depth-out-cut control.

There is a desired ratio of penetration rate per drill bit revolution where the drill-bit carbides penetrate and fracture the rock efficiently, resulting in desirable drilling speed and bit-wear characteristics. This ratio is referred to as the desired depth of cut (DOC). A rate of penetration (PR) can be calculated by multiplying the rotation speed (that is, the indexing of the bit) by the DOC. Prior-art methods have used a simple feedback loop to adjust the rotation rate applied to the bit to maintain an assumed optimum penetration rate. However, these methods do not efficiently adjust drilling for variations in hammer frequencies, or bit diameter, or the relative hardness of the rock. What is needed is a method of monitoring and adjusting these parameters to achieve optimum drilling efficiency by maintaining a penetration rate, depending on local drilling conditions.

Although this application is focused on solving problems in percussive blast-hole drilling operations, the disclosure and claims are equally applicable to the drilling of boreholes in other fields, such as oil and gas drilling.

DRAWINGS

Non-limiting embodiments of the present disclosure are described by way of example in the following drawings, which are schematic and are not intended to be drawn to scale:

SUMMARY

I disclose a method for maintaining a penetration rate of a drilling operation, where the drilling operation is carried out by a drilling rig having hammer drill apparatus. A reference penetration rate for the hammer drill bit is chosen. A starting depth of cut is computed from the reference penetration rate, the measured hammer frequency, and the drill bit parameters. The system measures the actual penetration rate of the drill bit and computes an actual depth of cut. From the actual depth of cut a target bit rotation speed is computed. The target rotation speed is compared to the actual rotation speed, and the rotation speed is adjusted up or down to set the bit rotation speed at a value that will maintain the target rotation speed, notwithstanding changes in hammer frequency or ground conditions.

DETAILED DESCRIPTION

Figure 1:
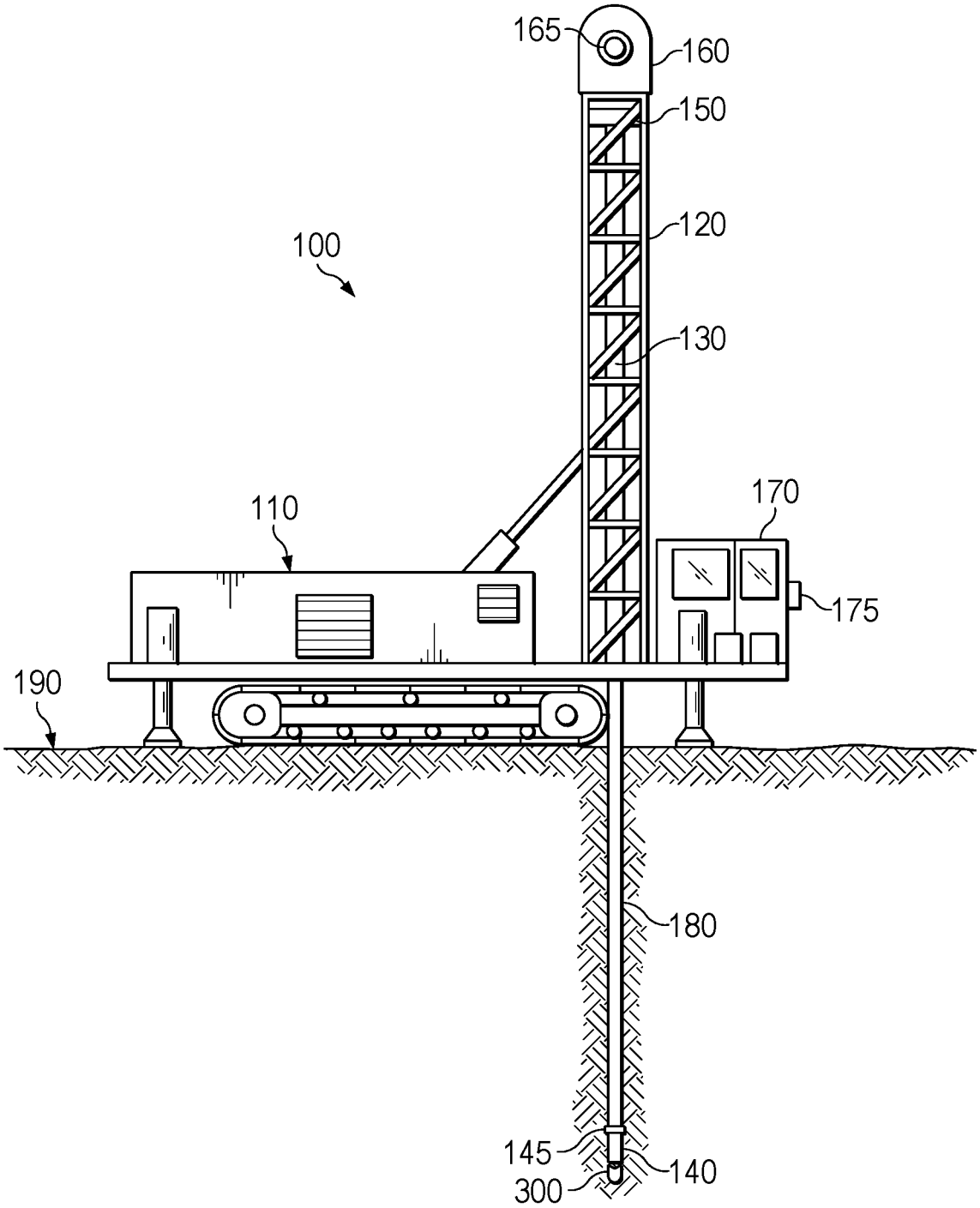
FIG. 1 depicts generally a drilling rig.

Referring to FIG. 1, in one embodiment, the drilling apparatus 100 may comprise a drilling rig 110 having a mast or derrick 120 configured to support a drill string 130 having a pneumatic hammer drill 140 provided on the end thereof, which pneumatic hammer drill 140 is connected to a drill bit 300. Drilling rig 110 may also be provided with various systems for operating the drill string 130 to form boreholes 180. For example, in the embodiments shown and described here, drilling rig 110 may also comprise a drill motor system 150, a drill hoist system 160, as well as an air injection system and a water injection system (not shown in FIG. 1). The term "hoist system" as used here refers to any system or actuator for raising and lowering the drill string, which may include a conventional pulley and sheave hoist system or actuator motors.

The drilling apparatus 100 comprises a control system 170 that is operatively associated with the drilling rig 110, as well as with the various systems thereof, e.g., a motor system 150, a hoist system 160, or an air injection system and water injection system (not shown in FIG. 1). As will be explained in greater detail below, control system 170 monitors various drilling parameters generated or produced by the various drill systems and controls them as necessary to form the borehole 180 into the surface of the formation 190.

The drill motor system 150 is connected to the drill string 130 and may be operated by a control system 170 to provide a rotational force or torque to rotate the drill bit 300 provided on the end of the pneumatic hammer drill 140. The drill motor system 150 may also be provided with various sensors and transducers, as described below, to allow the control system 170 to monitor or sense the hammer frequency, as well as the rotational speed and rate of penetration of the drill bit 300.

Figure 2:
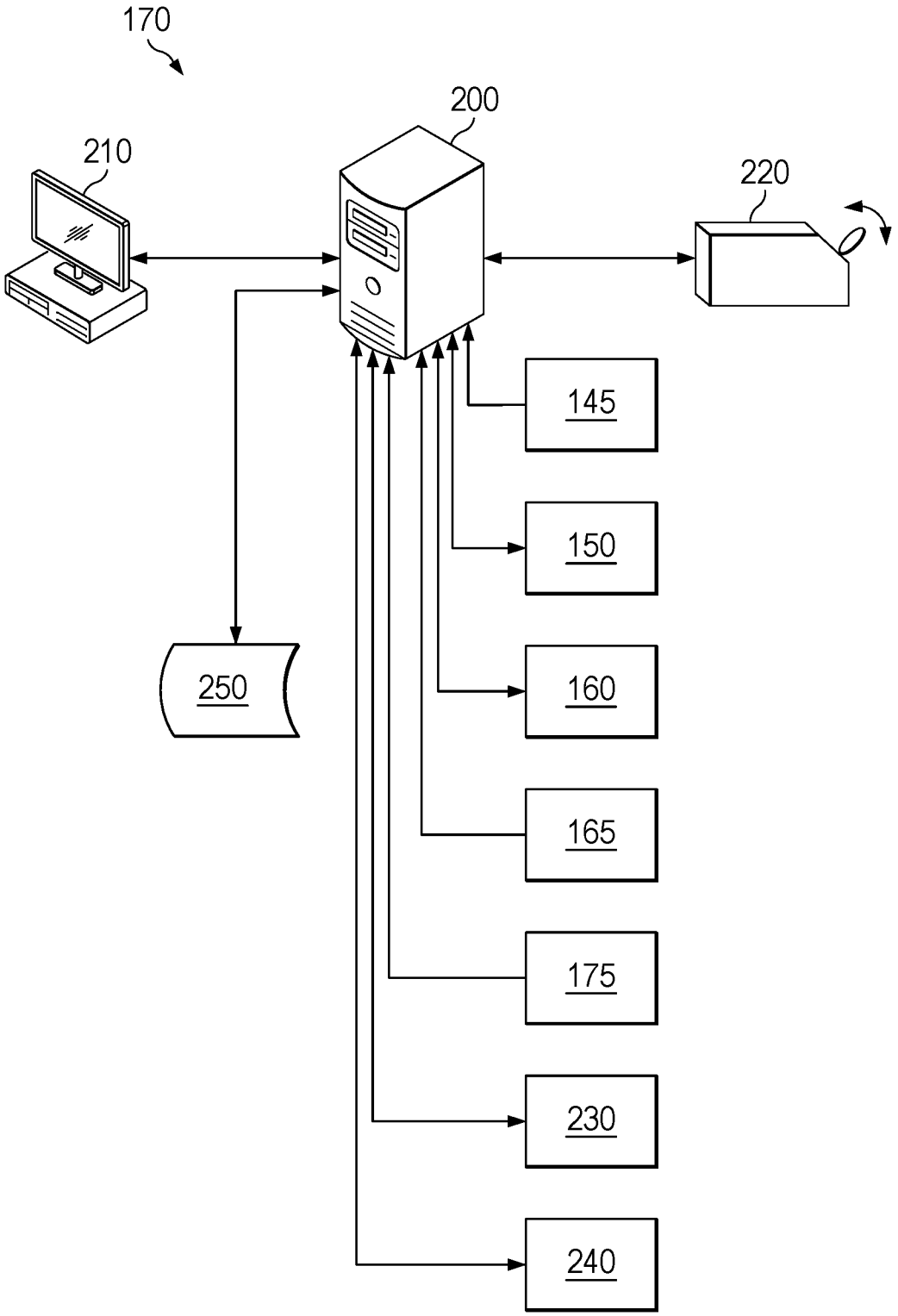
FIG. 2 depicts schematically functions comprising the control system of an embodiment.

FIG. 2 schematically shows the control system 170 referred to above at a high level. FIG. 2 is not limiting, and the control system 170 may comprise other and further components relevant to its function. The control system 170 includes a computer 200 that is typically a programmable digital computer comprising a read-only memory, a non-transitory computer readable storage medium for storing instructions executable by a processor (such as a random-access memory), a central-processing unit or processor, and a hard drive or flash memory or the like for further storage of programs and data, as well as input and output ports.

In FIG. 2, the drill hoist system 160 and the drill motor system 150 are shown schematically as operatively connected to the computer 200 of the control system. Also present in practical drilling systems, and also operatively connected to the computer 200, may be an air-injection system 230 and a water-injection system 240, which systems may also include various sensors and transducers to allow the control system 170 to monitor or sense the amounts or flows of injected fluids.

The control system 170 also may include a display 210 with a graphical user interface, and an operator's control console 220, connected to the computer 200 to receive inputs from an operator during a drilling operation, and provide information to the operator. The operator's console 220 may include a keyboard, keypad, joystick, mouse, or other input device. In this application, the collective input mechanisms of the operator's console 220 and the display 210 may be referred to generally as a graphical user interface, or GUI. The display 210 of the GUI may of course provide one or more pages of information and input fields to an operator. The operator console 220 may not necessarily be located on the drilling rig 110, but may be remotely connected to the control system.

Figure 3:
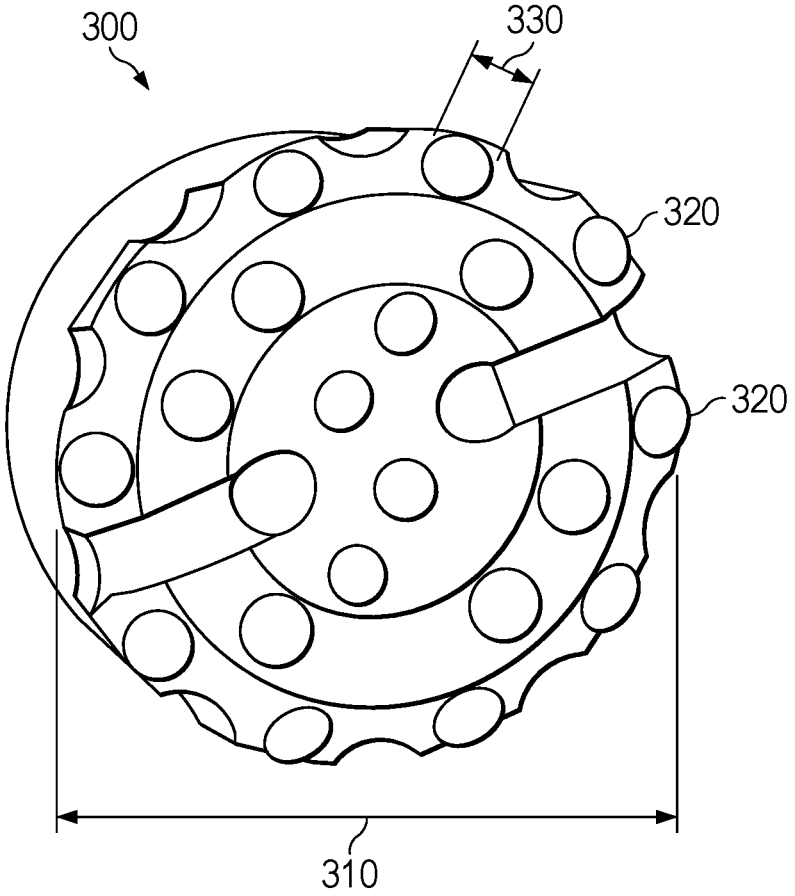
FIG. 3 is an illustration of a typical drill bit for percussive drilling, showing the relevant parts and dimensions thereof.
Figure 4A:
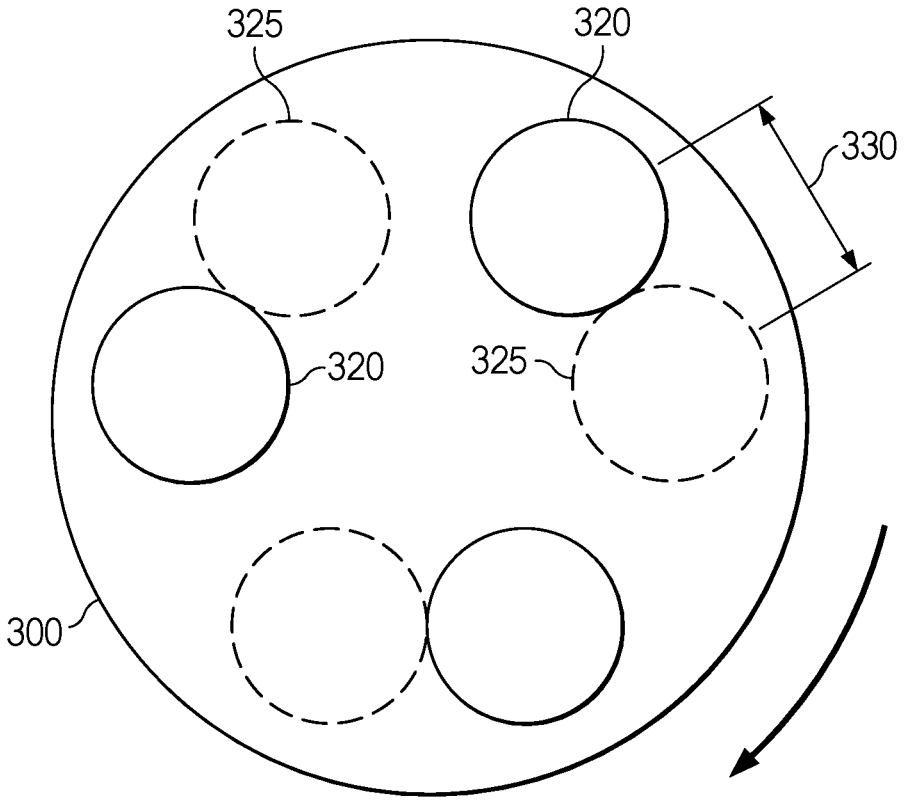
FIGS. 4A and 4B show different views of a drill bit and rotations thereof during the drilling process in soft rock.
Figure 4B:
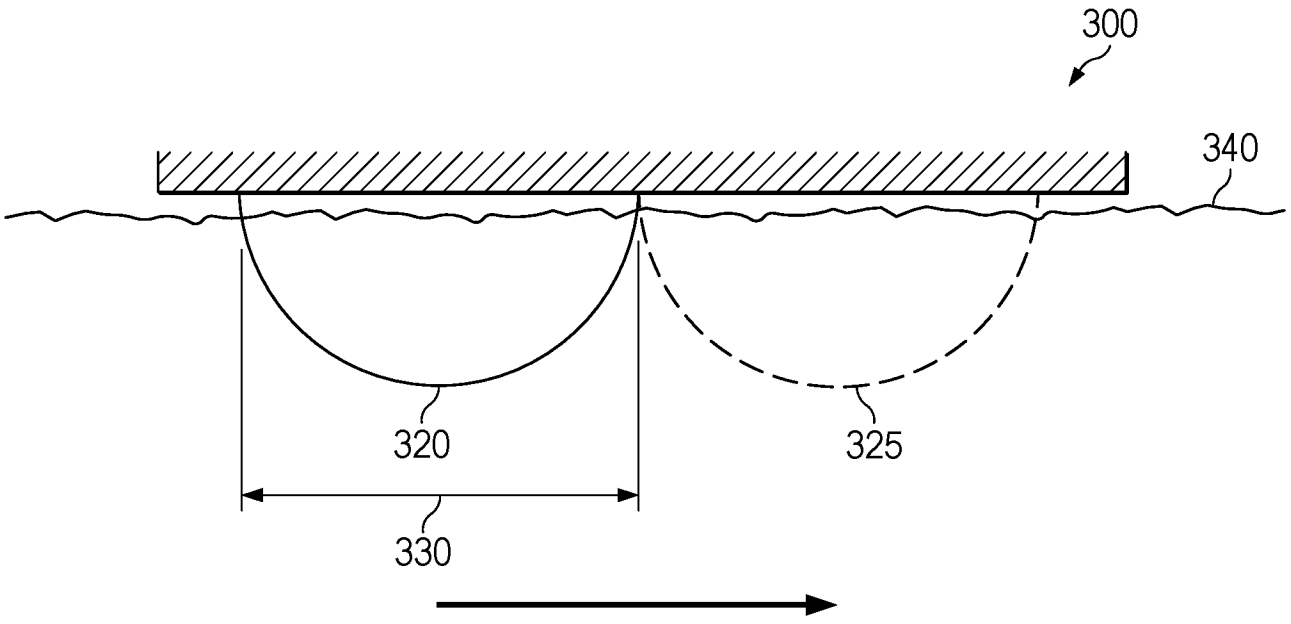
Figure 4C:
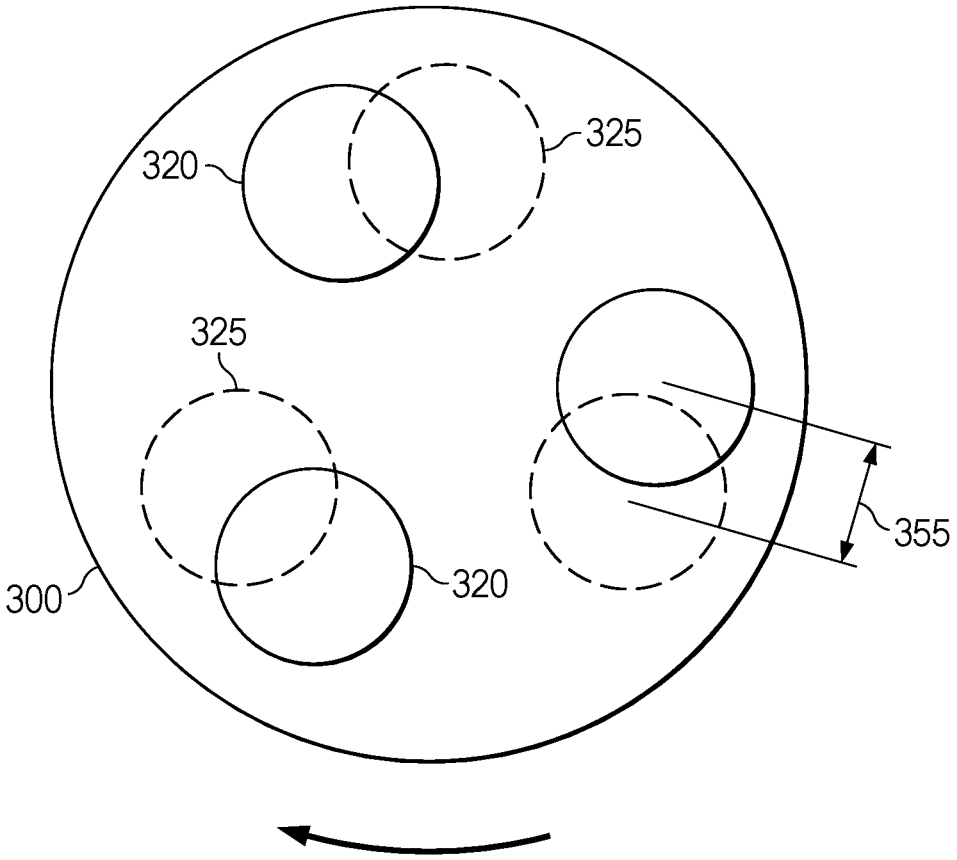
FIGS. 4C and 4D show different views of a drill bit and rotations thereof during the drilling process in hard rock.
Figure 4D:
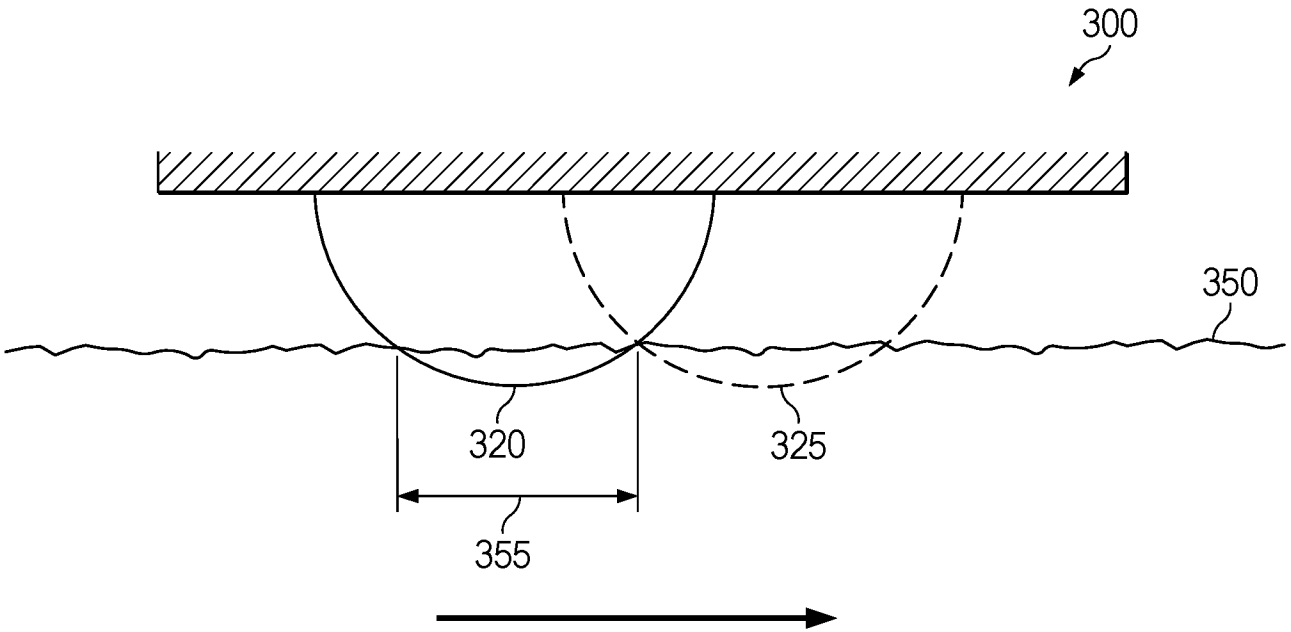

FIG. 3 illustrates a typical hammer-drill bit 300. The drill bit 300 has a bit diameter 310 and carries a plurality of hardened buttons 320, each typically made of a cemented carbide. Each button 320 has a button diameter 330. The pneumatic hammer 140 drives the impact of the drill bit 300 at some operating frequency. The drill motor system 150 rotates the drill bit 300 at a certain rotational speed to index the next strike of the buttons 320 away from the previous impacts to newly exposed rock between strikes.

FIG. 4 illustrates the travel of the drill bit 300 as it is rotated for successive impacts in soft and hard rock. FIG. 4A is a view looking upward at example drill bit 300 having buttons 320 as the same is rotated at a speed sufficient to obtain indexing equal to one button diameter 330 per hammer blow in soft rock. FIG. 4A shows the position 325 of a button 320 moved exactly one button diameter 330 by rotation of the drill bit 300. FIG. 4B is a side view of the same buttons 320, showing a rotation or indexing sufficient to move the position 325 of each button 320 one diameter 330 in soft rock 340. FIG. 4C is a view looking upward at an example drill bit 300 having buttons 320 as the same is rotated at a speed where the bit 300 is indexed less than one button diameter 330 per hammer blow in hard rock 350. FIG. 4D is a side view of the same buttons 320, showing an indexing sufficient to move the position 325 of each button 320 some amount less than one diameter of the button 320 (as measured at the base of the button 320), but equal to the diameter 355 of the portion of the button 320 below the rock face 350. The actual rotation speed is some fraction equal to or less than an ideal rotation speed, to maintain a set penetration rate, as is calculated as described in the following paragraphs.

A database 250 is provided as a part of the control system. The database 250 may have predetermined settings and parameters for achieving optimum performance of the drilling apparatus or system 100. Such settings and parameters can include physical characteristics, such as diameters of the pneumatic hammer drill, the drill bit 300, and, in some cases, the diameter of the drill bit buttons 320. The operating air pressures and hammer frequency in beats per minute for particular pneumatic hammer drills 140 may also be available in the database 250. In the operation of one embodiment of the drilling apparatus or system 100, an operator selects a display of information about the bit being used from a dropdown menu on the operating system GUI of the control console 220. From these inputs, calculations are performed as described below, and the optimum operating range for the bit chosen is used for automatic control of drilling, and also displayed as a reference for manual drilling. In some cases, where a needed parameter is missing, this can be entered by the operator in the GUI of the display 210.

First, the embodiment of system and method disclosed here calculates an ideal rotation speed as a target so as to rotate the bit 300 sufficiently so that a button 320 on the bit 300 has moved exactly one diameter around the circumference of the bit 300 between hammer strikes. This ideal indexing rotation speed (called RS here) is then assigned to a certain reference penetration rate to determine a depth of cut (called DOC here). As a non-limiting example a penetration rate of 1500 mm/minute would be reasonable for many drilling applications. For a bit rotation speed of, for example, 45 rpm, these values set the DOC at 1500 mm/min/45 RPM, which equals 33 mm/rotation of the bit 300.

The actual penetration rate of the bit 300 is measured, such as by taking the time derivative of the drill head position, which position may be measured using, for example, a rotary encoder 165 on a sheave in the drill feed system. As discussed below, the drilling control system 170 is programmed to adjust the rotation speed of the bit 300 based on the measured penetration rate to maintain the 33 mm/rotation ratio, as stated in the example in the previous paragraph, even though rock conditions may change during drilling.

Figure 5:
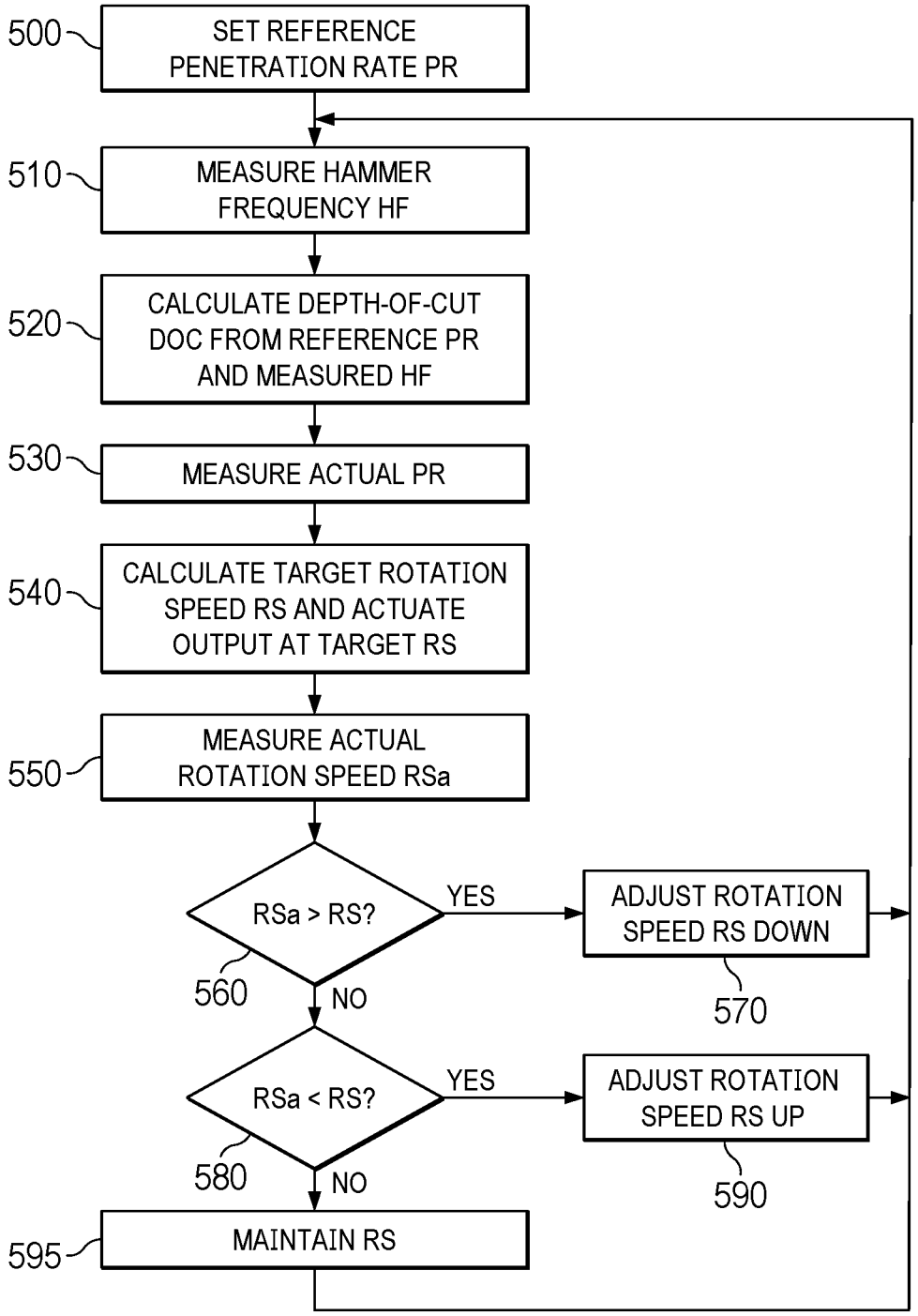
FIG. 5 is a flow chart illustrating generally the methods disclosed.

Stated procedurally, we illustrate the foregoing calculation in FIG. 5. At step 500, a reference penetration rate PR for the hammer drill bit 300 is chosen. The reference penetration rate PR can be chosen for ideal or average rock conditions, as, for example, known in the field. Then drilling is initiated as some initial rotation speed, where the rotation speed is reported by the drill motor system 150 on the drilling rig 110. The initial rotation speed may be chosen by reference to hammer-drill manufacturer's specification, and may be programmed into the database 250 of the drilling apparatus or system 100. (See, e.g., the "Quantum Leap Technical Manual" for hammer drills, published by Atlas Copco Secoroc AB, of Fagersta, Sweden.) Such specifications will typically include a nominal hammer frequency ("beats/minute") for a given air pressure. (In general, the hammer frequency will vary dynamically during drilling.)

At step 510 an initial hammer frequency HF is measured. This initial hammer frequency can alternatively be estimated from published hammer-drill specifications, as discussed in more detail below.

Step 520 computes a depth of cut DOC for the drill bit 300 according to the relationship $DOC=PR/(HF*D_{button}/(D_{bit}*\pi))$, where $D_{button}$ is the diameter 330 of the bit button 320, and $D_{bit}$ is the diameter 310 of the bit 300. At step 530, the system measures the actual penetration rate $PR_m$ as explained above and, at step 540, computes a target rotation speed $RS=PR_m/DOC$.

At step 550 the system measures the actual rotation speed $RS_a$. If $RS_a>RS$, then control passes to step 570, where the rotation speed RS is adjusted downward by the control of the drill motor system 150; else, a comparison is made again at step 580. After this comparison, if $RS_a<RS$, then control passes to step 590, where rotation speed RS is adjusted upward; else, if $RS_a=RS$ (within the limits of measurement accuracy), then the rotation speed RS is maintained at step 595. Finally, control from steps 570, 590, or 595 passes to step 510, where the current hammer frequency HF is again measured, and this value is passed to step 520 to re-compute the desired depth-of-cut DOC from the reference penetration rate PR and the current hammer frequency HF. The control loop continues after step 520 so long as drilling continues. In this way, the pre-determined penetration rate, PR, is maintained, although the hammer frequency HF and ground conditions may vary. In one embodiment, the target rotation speed is limited by maximum and minimum reasonable rotation speeds stored in the database 250.

Note that in this calculation, the rotation speed, RS, will be increased in proportion to an increase in the rate of penetration PR, the hammer frequency, HF, or the diameter 330 of the button, $D_{button}$ (if the bit were changed to one with differently-sized buttons, for example). The rotation speed RS will be decreased in proportion to an increase in the diameter, $D_{bit}$ of the bit 300. The diameter of the bit 300 and the diameter of the buttons 320 may be taken from manufacturer's publications, or, if necessary, measured in the field. Correspondingly, the rotation speed RS will be decreased in proportion to a decrease in the rate of penetration, or of the hammer frequency HF.

The above exemplary calculations imply a means for measuring the rate of penetration PR, and the hammer frequency HF, and transmitting such data to the control system 170. Hammer frequency may be measured by a accelerometer 145 attached to the pneumatic hammer 140, or by an acoustic pickup 175 on the drilling rig 110, or by fluctuations in drilling air pressure. A starting hammer frequency HF can be estimated from published hammer-drill information relating hammer frequency to air or hydraulic pressure driving the pneumatic hammer 140, which values are available in published manufacturer's manuals, as next discussed.

As an example of establishing a hammer frequency value, where no initial direct measurement is available, we can estimate the frequency from this example calculation:

$$HF=(m_press*hammer_diameter+b_press)*(bit_air_pressure+(m_frequency*hammer_diameter+b_frequency).$$

In the above equation, bit_air_pressure is measured by the pressure transducer (not shown) typically included on the drilling rig 110; this air pressure will influence the hammer frequency as air pressure increases or decreases while drilling. The "hammer diameter" in this case is not the same as the bit diameter 310 used in this application, but is a parameter available in the manufacturer's documentation. This "hammer diameter" will be input to the control system 170 through the GUI 210 by the operator. The coefficients m_press, b_press, m_frequency, and b_frequency can also be determined from manufacturer's published tables for hammer operating frequency of different diameter hammers through a range of pressures. These variables as described are only examples of relevant parameters to hammer frequency, and do not limit the claims.

The actual rate of penetration $PR_m$, in the calculation above can be determined by taking the time derivative of the drill head position, which position is measured using, for example, a rotary encoder 165 on a hoist sheave 160 in the drill feed system. A ideal or reference rate of penetration PR can be determined by field testing of particular machines with particular hammer drill systems, in particular rock formations, to arrive at a starting value where there is 100% indexing of the drill bit 300; that is, with no overlap of strikes by the buttons 320. Normal drilling speeds will usually be somewhat less than this reference value due to hardness of the rock, although the reference value is not limiting, and faster rates of penetration will be available in softer ground.

None of the description in this application should be read as implying that any particular element, step, or function is an essential element which must be included in the claim scope; the scope of patented subject matter is defined only by the allowed claims. Moreover, none of these claims are intended to invoke 35 U.S.C. Section 112(f) unless the exact words "means for" are used, followed by a gerund. The claims as filed are intended to be as comprehensive as possible, and no subject matter is intentionally relinquished, dedicated, or abandoned.

I claim:

1. A method for maintaining a target rotation speed RS of a hammer drill apparatus in a drilling operation, wherein the drilling operation is carried out by a drilling rig having a drill motor and the hammer drill apparatus; the hammer drill apparatus having a reference penetration rate PR for a hammer drill bit, a bit diameter $D_{bit}$, a bit button diameter $D_{button}$, and a hammer frequency HF; the method comprising:

choosing the reference penetration rate PR for the hammer drill bit;

measuring the hammer frequency HF;

computing a starting depth-of-cut DOC for the hammer drill bit equal to PR I $(HF*D_{button}/(D_{bit}*\pi))$;

measuring an actual penetration rate $PR_m$ of the hammer drill bit;

computing the target rotation speed RS for the hammer drill apparatus equal to $PR_m$ I DOC; and, sending a command to actuate the drill motor at the target rotation speed RS.

2. The method of claim 1, wherein measuring the actual penetration rate $PR_m$ of the hammer drill bit comprises taking a time derivative of a position of the hammer drill apparatus.

3. The method of claim 2, wherein the position of the hammer drill apparatus is measured by a rotary encoder.

4. The method of claim 1, wherein measuring the hammer frequency HF comprises detecting the hammer frequency HF by an acoustic pickup.

5. The method of claim 1, wherein measuring the hammer frequency HF comprises detecting an output of an accelerometer.

6. The method of claim 1, wherein the drilling rig further comprises a supply of bit air pressure; and wherein measuring the hammer frequency HF comprises measuring fluctuations in bit air pressure corresponding to the hammer frequency HF.

7. The method of claim 1, wherein the target rotation speed RS is limited between maximum and minimum target rotation speeds.

8. A method for maintaining a target rotation speed RS of a hammer drill apparatus in a drilling operation, wherein the drilling operation is carried out by a drilling rig having a drill motor and the hammer drill apparatus; the hammer drill apparatus having a bit rotation speed RS, a bit diameter $D_{bit}$, a bit button diameter $D_{button}$, and a hammer frequency HF; the method comprising:

choosing a reference penetration rate PR for a hammer drill bit;

measuring the hammer frequency HF;

computing a starting depth-of-cut DOC for the hammer drill bit equal to PR I $(HF*D_{button}/(D_{bit}*\pi))$;

measuring an actual penetration rate $PR_m$ of the hammer drill bit;

computing the target rotation speed RS for the hammer drill apparatus equal to $PR_m$/DOC;

measuring an actual rotation speed $RS_a$ for the hammer drill apparatus;

comparing the target rotation speed RS to the actual rotation speed $RS_a$;

adjusting the actual rotation speed $RS_a$ of the hammer drill apparatus downward if $RS_a$>RS;

adjusting the actual rotation speed $RS_a$ of the hammer drill apparatus upward if $RS_a$<RS;

maintaining the actual bit rotation speed $RS_a$ of the hammer drill apparatus if $RS_a$=RS;

continue measuring the hammer frequency HF.

9. The method of claim 8, wherein measuring the actual penetration rate $PR_m$ of the hammer drill bit comprises taking a time derivative of a position of the hammer drill apparatus.

10. The method of claim 9, wherein the position of the hammer drill apparatus is measured by a rotary encoder.

11. The method of claim 8, wherein measuring the hammer frequency HF comprises detecting the hammer frequency HF by an acoustic pickup.

12. The method of claim 8, wherein measuring the hammer frequency HF comprises detecting an output of an accelerometer.

13. The method of claim 8, wherein the drilling rig further comprises a supply of bit air pressure; and wherein measuring the hammer frequency HF comprises measuring fluctuations in bit air pressure corresponding to the hammer frequency HF.

14. The method of claim 8, wherein the target rotation speed RS is limited between maximum and minimum target rotation speeds.

15. A drilling machine for drilling through rock, the drilling machine comprising:

a hammer drill bit;

the hammer drill bit further comprising a bit diameter, and bit buttons;

the bit buttons further comprising a bit button diameter;

a motor for rotating the hammer drill bit while causing the hammer drill bit to strike a rock face;

a sensor for detecting a penetration rate of the hammer drill bit;

a sensor for detecting a frequency of striking of the hammer drill bit;

a computer operatively connected to the sensor for detecting the penetration rate of the hammer drill bit, and further connected to the sensor for detecting the frequency of striking of the hammer drill bit;

the computer further connected to the motor for rotating the hammer drill bit;

the computer programmed to:

compute an actual depth of cut of the hammer drill bit from the bit diameter, the bit button diameter, the penetration rate of the hammer drill bit and the frequency of striking of the hammer drill bit;

compute a target rotation speed from the penetration rate of the hammer drill bit and the actual depth of cut of the hammer drill bit; and, cause the motor for rotating the hammer drill bit to adjust a rotation speed of the hammer drill bit to maintain the rotation speed of the hammer drill bit equal to the target rotation speed.

16. The drilling machine of claim 15, wherein the sensor for detecting the penetration rate of the hammer drill bit is a rotary encoder.

17. The drilling machine of claim 15, wherein the sensor for detecting the frequency of striking of the hammer drill bit comprises an acoustic detector.

18. The drilling machine of claim 15, wherein the sensor for detecting the frequency of striking of the hammer drill bit comprises an accelerometer.

19. The drilling machine of claim 15, wherein the drilling machine further comprises a source of bit air pressure; the sensor for detecting the frequency of striking of the hammer drill bit comprising a detector of fluctuations in bit air pressure.

20. The drilling machine of claim 15, wherein the computer further comprises a database of drilling parameters.

21. The drilling machine of claim 15, wherein the computer further comprises a database; the database storing maximum and minimum bit rotation speeds; the computer further programmed to limit the target rotation speed between maximum and minimum rotation speeds stored in the database.

* * * * *